US006326938B1

(12) United States Patent
Ishida et al.

(10) Patent No.: US 6,326,938 B1
(45) Date of Patent: Dec. 4, 2001

(54) POWER CONSUMPTION CONTROL IN DISPLAY UNIT

(75) Inventors: Katsuhiro Ishida; Masaya Tajima; Kiyoshi Takata; Hirohito Kuriyama, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/250,433

(22) Filed: Feb. 16, 1999

(30) Foreign Application Priority Data

Mar. 26, 1998 (JP) ..... 10-079793

(51) Int. Cl.[7] ..... G09G 3/28
(52) U.S. Cl. ..... 345/63; 345/77; 345/211
(58) Field of Search ..... 345/41, 42, 60, 345/63, 77, 89, 211, 212; 313/582

(56) References Cited

U.S. PATENT DOCUMENTS

| | | | | |
|---|---|---|---|---|
| 5,298,893 | * | 3/1994 | Sekine | 345/63 |
| 5,315,695 | * | 5/1994 | Saito et al. | 345/432 |
| 5,347,294 | * | 9/1994 | Usui et al. | 345/89 |
| 5,541,618 | * | 7/1996 | Shinoda | 345/60 |
| 5,583,527 | * | 12/1996 | Fujisaki et al. | 345/55 |
| 5,943,032 | * | 8/1999 | Nagaoka et al. | 345/63 |
| 5,956,014 | * | 9/1999 | Kuriyama et al. | 345/147 |
| 6,100,859 | | 8/2000 | Kuriyama et al. . | |
| 6,104,362 | | 8/2000 | Kuriyama et al. . | |

FOREIGN PATENT DOCUMENTS

| | | |
|---|---|---|
| 0 653 740 | 5/1995 | (EP) . |
| 0 655 722 | 5/1995 | (EP) . |
| 2-39092 | 2/1990 | (JP) . |
| 2-91687 | 3/1990 | (JP) . |
| 2-125288 | 5/1990 | (JP) . |
| 6-348227 | 12/1994 | (JP) . |
| 7-44127 | 2/1995 | (JP) . |
| 8-160912 | 6/1996 | (JP) . |

* cited by examiner

*Primary Examiner*—Bipin Shalwala
*Assistant Examiner*—Ricardo Osorio
(74) *Attorney, Agent, or Firm*—Staas & Halsey LLP

(57) ABSTRACT

Power consumption control is performed that does not induce unnatural changes in brightness even when data causing an abrupt change in load ratio is input, and that can make the power consumption settle down to the desired value. The load ratio is calculated from data input to a display apparatus, and the load ratio is again calculated this time backward from the present brightness value; if the difference between the two calculated values is greater than a threshold value, a new brightness value is calculated from the load ratio, and the brightness is set to the newly calculated value. Thereafter, the brightness is controlled based on measured power consumption values.

23 Claims, 9 Drawing Sheets

PRIOR ART

PRIOR ART

POWER CONSUMPTION CONTROL IN DISPLAY UNIT

BACKGROUND OF THE INVENTION

1. Field of the Invention

The present invention relates to a method and apparatus for controlling power consumption in a display apparatus, particularly a display apparatus having a plasma display panel, and more particularly a display apparatus having an AC-driven plasma display panel. The invention also relates to a display system equipped with such a power consumption control apparatus, and a storage medium storing therein a program for implementing such a power consumption control method.

2. Description of the Related Art

Traditionally, power consumption control in a display apparatus, particularly a display apparatus having an AC-driven plasma display panel (PDP), has been performed by continuously monitoring power consumption that changes with changing display data, and by reducing the brightness of the entire screen when the power consumption exceeds its upper limit value and increasing the brightness when the power consumption drops below its lower limit value.

On the other hand, Japanese Unexamined Patent Publication No. 6-332397 discloses a control method in which display ratio is calculated by cumulatively adding display signals applied externally during a prescribed period, especially, one frame period, and the power consumption is controlled by setting the screen brightness to a value appropriate to the display ratio.

According to the former control method, when the display changes from ALL OFF to ALL ON state, since the screen brightness has been controlled up to the maximum during the ALL OFF period, the entire screen goes into the ALL ON state while the brightness is still controlled at the maximum value and, therefore, the power consumption at this time is higher than the predetermined value and the brightness must be reduced. If the speed with which the brightness is reduced is slow, the displayed image becomes gradually dark even when there is no change in the input display data. If the speed is increased, the image will appear to flash momentarily. In either case, an image quality problem will occur.

Such a problem does not occur with the latter control method since feedback control is not performed in the latter method. Not performing feedback control, however, involves a problem in that the power consumption relative to the display ratio varies from one display panel to another because of manufacturing variations.

SUMMARY OF THE INVENTION

It is, accordingly, an object of the present invention to provide power consumption control that does not induce unnatural changes in brightness even when the ON/OFF state of the display changes abruptly, and that can control power consumption at the desired value regardless of manufacturing variations.

According to the present invention, there is provided a power consumption control method for a display unit, comprising the steps of: calculating a screen load ratio from display data to be applied to the display unit; measuring power consumption in the display unit; and controlling screen brightness based on the calculated load ratio and the measured power consumption.

According to the present invention, there is also provided a power consumption control apparatus for a display unit, comprising: means for calculating a screen load ratio from display data to be applied to the display unit; means for measuring power consumption in the display unit; and means for controlling screen brightness based on the calculated load ratio and the measured power consumption.

According to the present invention, there is also provided a display system comprising: the above-described power consumption control apparatus; a plasma display panel; a drive circuit for driving the plasma display panel; and a control circuit for controlling the drive circuit based on a brightness value supplied from the power consumption control apparatus.

According to the present invention, there is also provided a storage medium storing therein a program for implementing the above-described power consumption control method in a computer.

DESCRIPTION OF THE PREFERRED EMBODIMENTS

Figure 1:
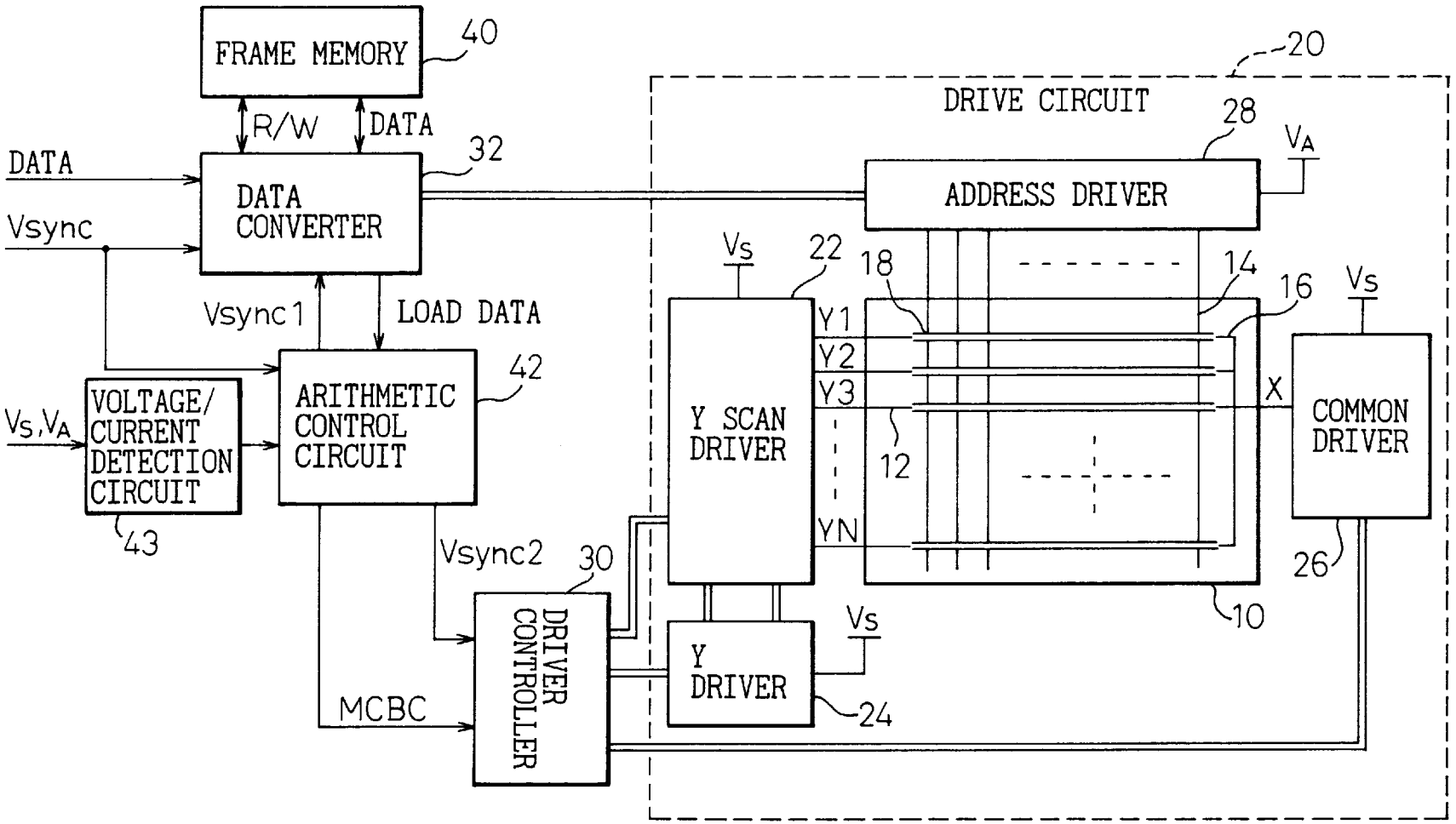
FIG. 1 is a block diagram showing the configuration of a plasma display apparatus according to the present invention.

FIG. 1 shows the configuration of an AC-driven plasma display apparatus as an example of a display apparatus to which the present invention is applied.

A plasma display panel (PDP) 10 includes a large number of Y electrodes (scan electrodes) 12 arranged parallel to each other, a large number of address electrodes 14 arranged parallel to each other and intersecting at right angles to the Y electrodes 12, and X electrodes (common electrodes) 16 equal in number to the Y electrodes and arranged parallel to the Y electrodes. Display cells 18 are formed where the address electrodes 14 intersect with the electrodes 12 and 16.

A drive circuit 20 for the PDP 10 comprises a Y scan driver 22 for driving the Y electrodes 12 independently of each other, a Y driver 24 for driving all the Y electrodes 12 simultaneously via the Y scan driver 22, a common driver 26 for driving all the X electrodes 16 simultaneously, and an address driver 28 for controlling the address electrodes 14 independently of each other. The Y scan driver 22, the Y driver 24, and the common driver 26 are supplied with a sustain supply voltage $V_S$, while the address driver 28 is supplied with an address supply voltage $V_A$.

As is well known, in the AC-driven PDP, during an address period a write pulse is selectively applied between a Y electrode 12 and an address electrode 14 to selectively store a charge in the corresponding display cell and, during a sustained-discharge period following the address period, AC pulses (sustain pulses) are applied between all the Y electrodes 12 and all the X electrodes 16, and only display cells, where the charge has been stored during the address period, are caused to glow. Accordingly, when one Y electrode 12 as a scan line is active, the pattern of the address electrodes 14 that are active at that time corresponds to the on/off pattern of the display cells along that scan line, and the length of the subsequent sustained-discharge period, that is, the number of sustain pulses, corresponds to the brightness of the glowing display cells.

A driver controller 30 sequentially scans the Y electrodes 12 via the scan driver 22 during the address period, and applies sustain pulses between the Y electrodes 12 and X electrodes 16 via the Y driver 24 and common driver 26 during the sustained-discharge period. Following a vertical synchronizing signal $V_{SYNC}$, data are sequentially input to a data converter 32 and temporarily stored in a frame memory 40. At this time, if the number of dots per raster, the number of frames per unit time, etc. in the input data do not match those specified for the operation of the PDP 10, appropriate data conversion is performed in the data converter 32 before the data are stored in the frame memory 40. In the address period, the data converter 32 reads data from the frame memory 40 one line at a time as each Y electrode is scanned, and supplies a display pattern for that scan line to the address electrodes 14 via the address driver 28.

An arithmetic control unit 42 is constructed from a microprocessor unit (MPU) having an internal A/D converter, ROM, etc. The internal ROM holds not only a program for power consumption control described in detail later, but also a program for generating from an externally supplied vertical synchronizing signal $V_{SYNC}$ vertical synchronizing signals $V_{SYNC}1$ and $V_{SYNC}2$ that match the operating specification of the PDP 10, and for supplying the respective signals to the data converter 32 and the driver controller 30. The internal A/D converter converts an analog value detected by a current/voltage detection circuit 43 into a digital value which is supplied to the MPU. The A/D converter and ROM may be external to the MPU.

Figure 2:
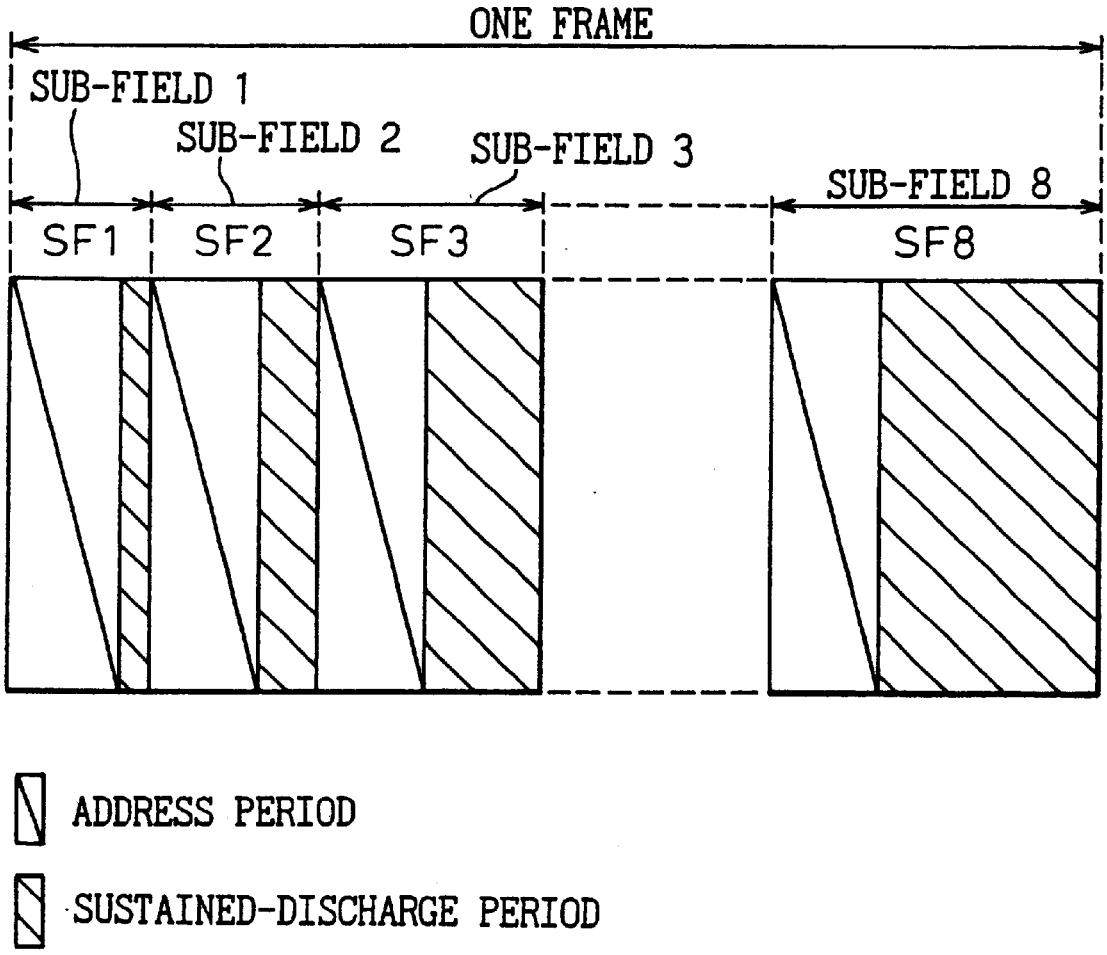
FIG. 2 is a diagram showing a sub-frame structure for achieving an intermediate gray-scale level.

FIG. 2 is a diagram for explaining a technique for achieving an intermediate gray-scale level in the AC-driven PDP. One frame (corresponding to one picture) is divided, for example, into eight sub-fields. Each sub-field includes an address period during which a charge is selectively stored or not stored in each display cell in accordance with the display data, and a sustained-discharge period during which the display cells where the charge is stored are caused to glow. The ratio of the sustained-discharge period lengths between the sub-field 1, sub-field 2, . . . , sub-field 8, that is, the ratio in terms of the number of sustain pulses, is set to $2^0:2^1 \ldots 2^7$. During the address period of the sub-field 1 the ratio of whose sustained-discharge period is $2^0$, charge is stored only on display cells for which the least significant bit 0 of 8-bit gray-scale data is 1, and during the following sustained-discharge period, these display cells are caused to glow. Likewise, during the address period of the sub-field i+1 (i=1 to 7) the ratio of whose sustained-discharge period length is $2^i$, charge is stored only on display cells for which bit i of the gray-scale data is 1, and during the following sustained-discharge period, these display cells are caused to glow. In this way, the gray scale of each pixel can be set in 256 levels. There are also cases where there are a plurality of sub-fields of identical length and the sub-fields are not arranged in order of length, as described in Japanese Unexamined Patent Publication Nos. 7-271325 and 9-311662.

The brightness of the entire screen is set by increasing or decreasing the number of sustain pulses in accordance with a brightness set value (hereinafter called MCBC) while keeping the ratio of the number of sustain pulses between the respective sub-fields at the above-set value. The number of sustain pulses determined for each sub-field based on MCBC is supplied to the driver controller 30.

Figure 3:
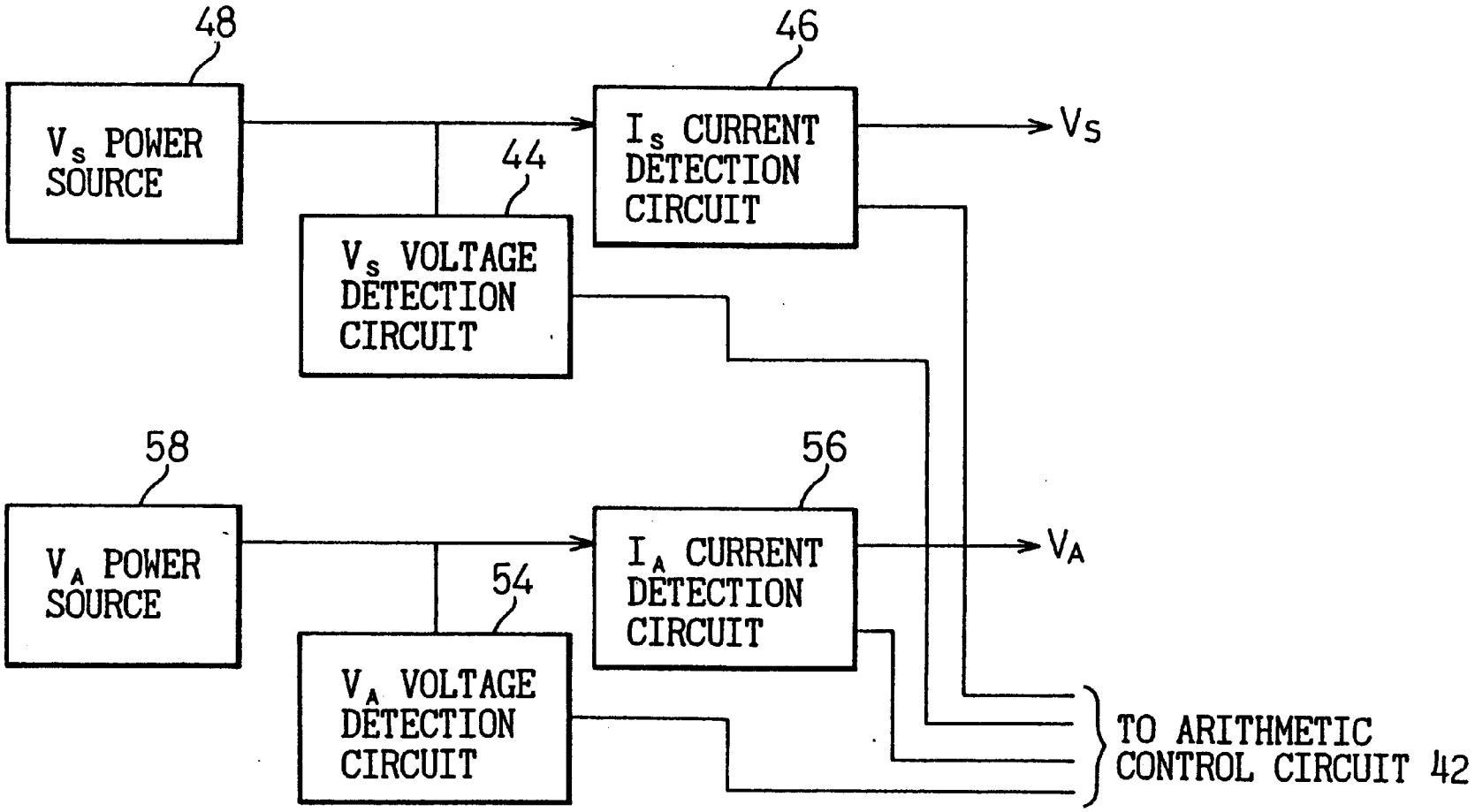
Fig.3 PRIOR ART
FIG. 3 is a diagram showing the configuration of a voltage/current detection circuit 43 in FIG. 1.

FIG. 3 is a block diagram showing the configuration of the voltage/current detection circuit 43 (FIG. 1). A $V_S$ voltage detection circuit 44 and an $I_S$ current detection circuit 46, respectively, detect the voltage and current of the sustain power supply being supplied from a $V_S$ power source 48 to the Y scan driver 22, Y driver 24, and common driver 26 (FIG. 1). A $V_A$ voltage detection circuit 54 and an $I_A$ current detection circuit 56, respectively, detect the voltage and current of the address power supply being supplied from a $V_A$ power source 58 to the address driver 28 (FIG. 1).

Figure 4:
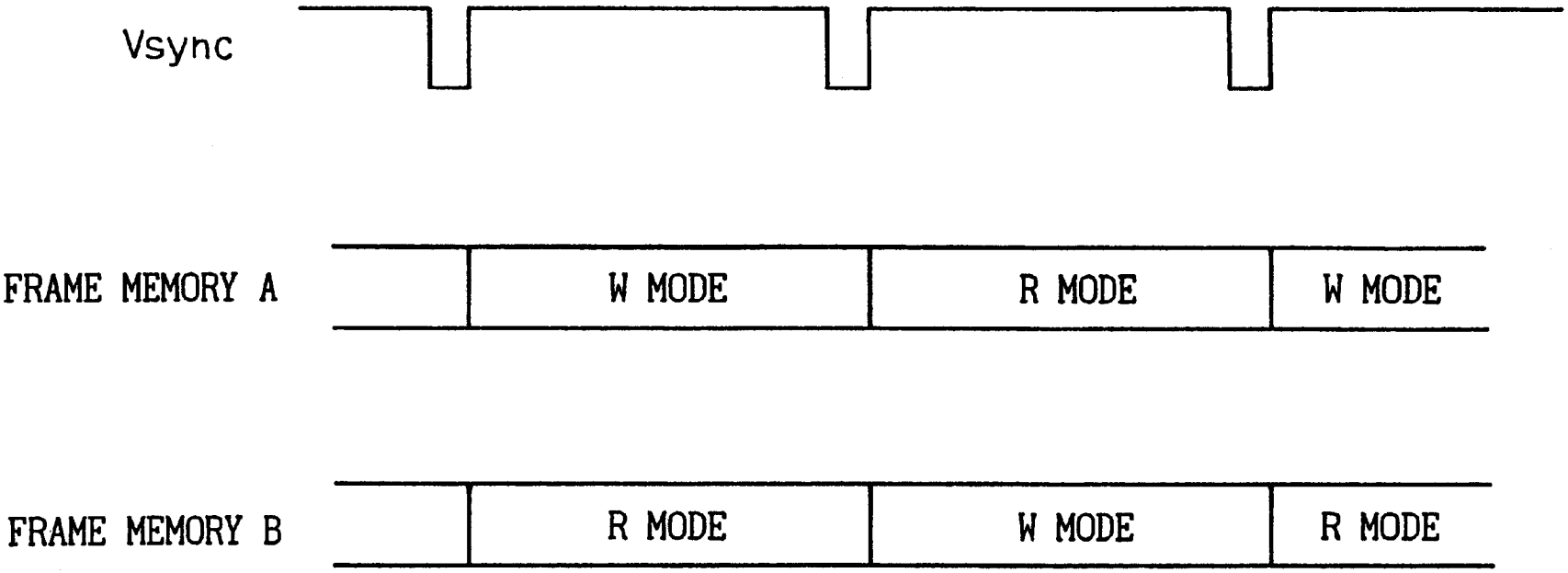
FIG. 4 is a timing chart showing write and read timings to frame memories.

FIG. 4 is a timing chart for read and write operations to the frame memory 40 (FIG. 1). The frame memory 40 includes a frame memory A and a frame memory B, each capable of storing data for one frame. As shown in FIG. 4, one memory is in the write mode (W mode) while the other is in the read mode (R mode). One mode thus alternates with the other in synchronism with $V_{SYNC}$ to enable continuous data write and read operations. In each of the frame memories A and B, after conversion and writing of data for one frame is completed, data read and display is performed in the following frame period. As explained with reference to FIG. 2, each frame period begins with an address period. Therefore, if the brightness appropriate to the load ratio (described later) of the screen about to be displayed can be calculated within the address period, the number of sustain pulses appropriate to the calculated brightness can be applied during the following sustain period. That is, even when there occurs an abrupt change in the load ratio, the brightness can be changed according to the changing load ratio before the screen is displayed.

Figure 5:
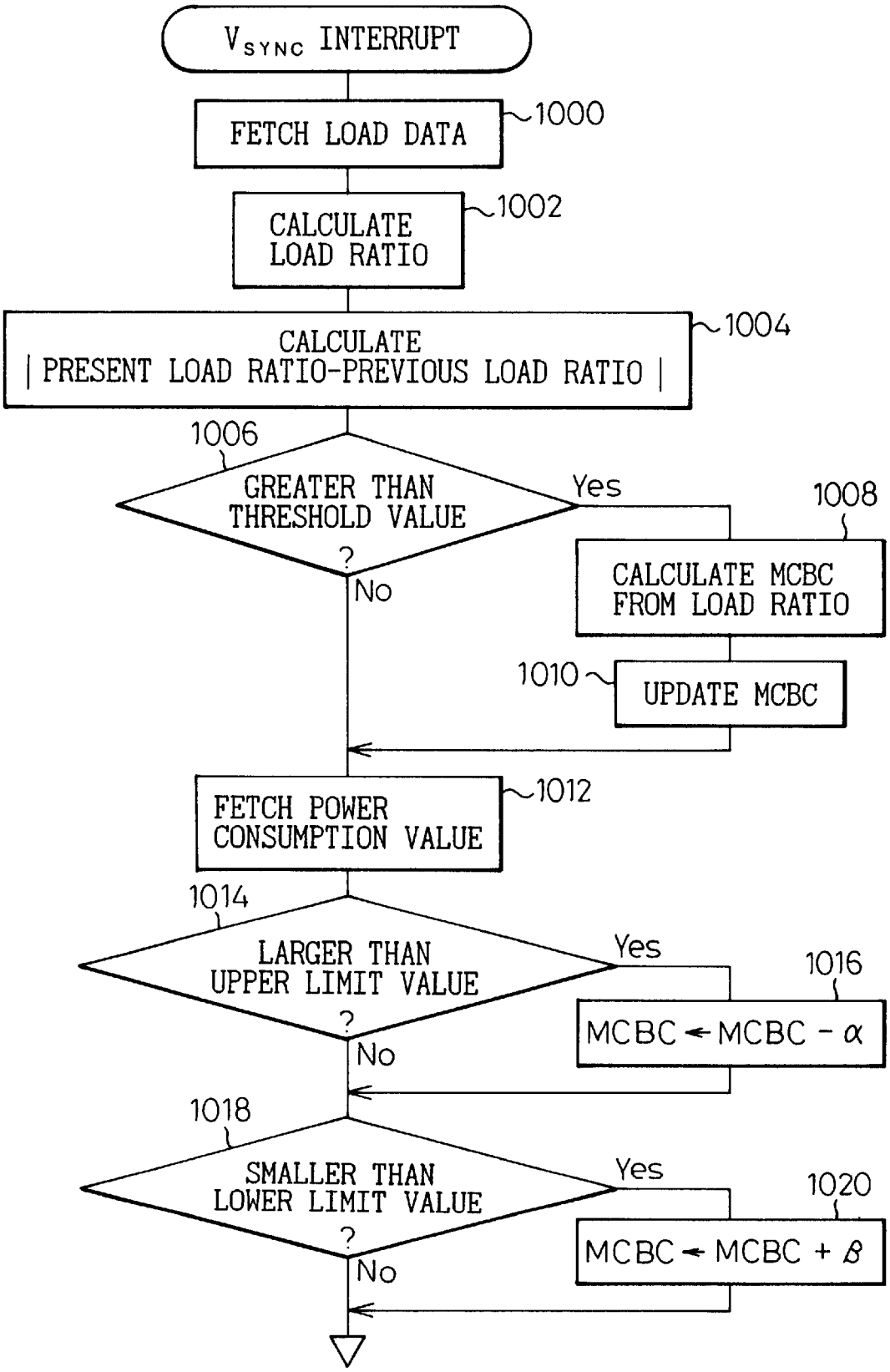
FIG. 5 is a flowchart illustrating power consumption control according to a first embodiment of the present invention.

FIG. 5 is a flowchart illustrating the power consumption control process performed in the arithmetic control circuit 42 according to a first embodiment of the present invention. This process is invoked by a $V_{SYNC}$ interrupt. First, load data for the currently displayed screen, that is, data indicating the ON ratio (the ratio of ON pixels) in each subframe or data indicating the ON/OFF state of each pixel in each subframe, is fetched from the data converter 32 (step 1000), and the load ratio is calculated by taking a sum over all the subframes in accordance with the following equation (in the case of the ON/OFF state data, after calculating the ON ratio from the ON/OFF state data) (step 1002).

$$(\text{Load ratio})=\Sigma\{(\text{ON ratio})\times(\text{brightness ratio})\}\times 100\% \quad (1)$$

where the brightness ratio is the ratio of the number of sustain pulses in each subframe to the total number of sustain pulses. Load ratio is 100% when the gray-scale level of every pixel is maximum (all ON), and 0% when the gray-scale level of every pixel is minimum (all OFF). On the other hand, when the gray-scale level of every pixel is at the midpoint value, or when 50% of the pixels are at the maximum gray-scale level and the remaining pixels at the minimum gray-scale level, the load ratio is 50%.

Next, the amount of change of the load ratio is calculated by taking the absolute difference between the present and previous load ratios (step 1004), and if the amount of change is greater than a predetermined threshold value, an MCBC value is calculated from the load ratio a(%) using, for example, the following equation.

$$MCBC=256\ (1-a/100) \quad (2)$$

From the above equation, MCBC=0 (smallest) when the load ratio is 100%, MCBC=128 when it is 50%, and MCBC=255 (largest) when it is 0%. Alternatively, MCBC may be made to take the largest value when the load ratio becomes a predetermined value larger than 0% and MCBC maintains the largest value when the load ratio is at or below the predetermined value. After updating the MCBC value by the calculated value (step 1010), the process joins the branch that would have been followed when the amount of change was not greater than the threshold in step 1006.

Next, the values of $V_S$, $I_S$, $V_A$, and $I_A$ are fetched via the A/D converter, and power consumption is calculated using the following equation (step 1012).

$$\text{Power consumption}=V_S\times I_S+V_A\times I_A \quad (3)$$

If the power consumption value is larger than a predetermined upper limit value (step 1014), the MCBC value is decreased by $\alpha$ (constant) (step 1016), and if the power consumption value is smaller than a predetermined lower limit value (step 1018), the MCBC value is increased by $\beta$ (constant) (step 1020). Here, since $I_A$ does not depend on brightness but depends only on display pattern, the power consumption may be calculated from $I_S$ and $V_S$ using the following equation.

$$\text{Power consumption}=V_S\times I_S \quad (3')$$

In the above process, the value of the load ratio is not immediately reflected in the MCBC value, but the MCBC value is updated to the value determined by the load ratio only when there occurs a change in the load ratio in excess of the threshold; this is not only to make subsequent control by the power consumption value effective, but also to prevent small variations in load ratio from being instantly reflected in brightness, causing flicker.

The first embodiment, however, has the problem that control of the power consumption value becomes impossible when variations, if not larger than the threshold, occur in the load ratio so often that control by the power consumption value can no longer handle. The second embodiment of the present invention shown in the flowchart of FIG. 6 improves on this point. In the second embodiment, the amount of change of the load ratio is added cumulatively, considering the sign of the amount of change. In step 1006, it is determined whether the cumulative sum is larger than a threshold value; if it is larger than the threshold value, the cumulative sum is cleared (step 1007), after which a new MCBC value is calculated from the load ratio, and the MCBC value is updated to the new value. The other steps are the same as those shown in FIG. 5, and a further description thereof is omitted here.

Figure 6:
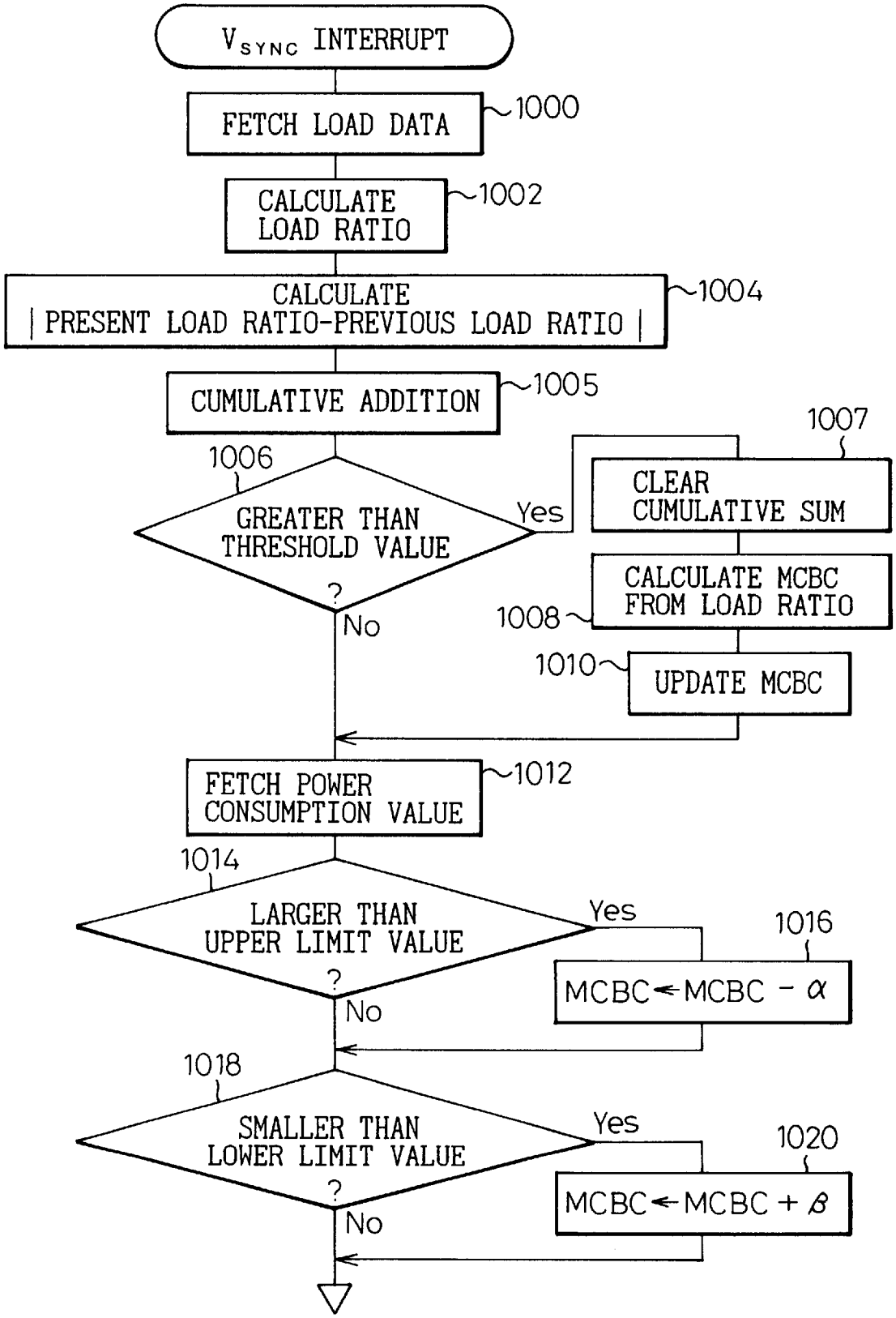
FIG. 6 is a flowchart illustrating power consumption control according to a second embodiment of the present invention.

The cumulative sum of the change of amount in the embodiment of FIG. 6 is nothing but the difference between the load ratio before the cumulative addition was started and the present load ratio. Accordingly, if the first embodiment shown in FIG. 5 is modified so that the previous value of the load ratio is not updated every time but is updated only when the difference from the present value is greater than the threshold value, as shown in FIG. 7 (step 1009), a result equivalent to that in the embodiment shown in FIG. 6 can be obtained.

Figure 8:
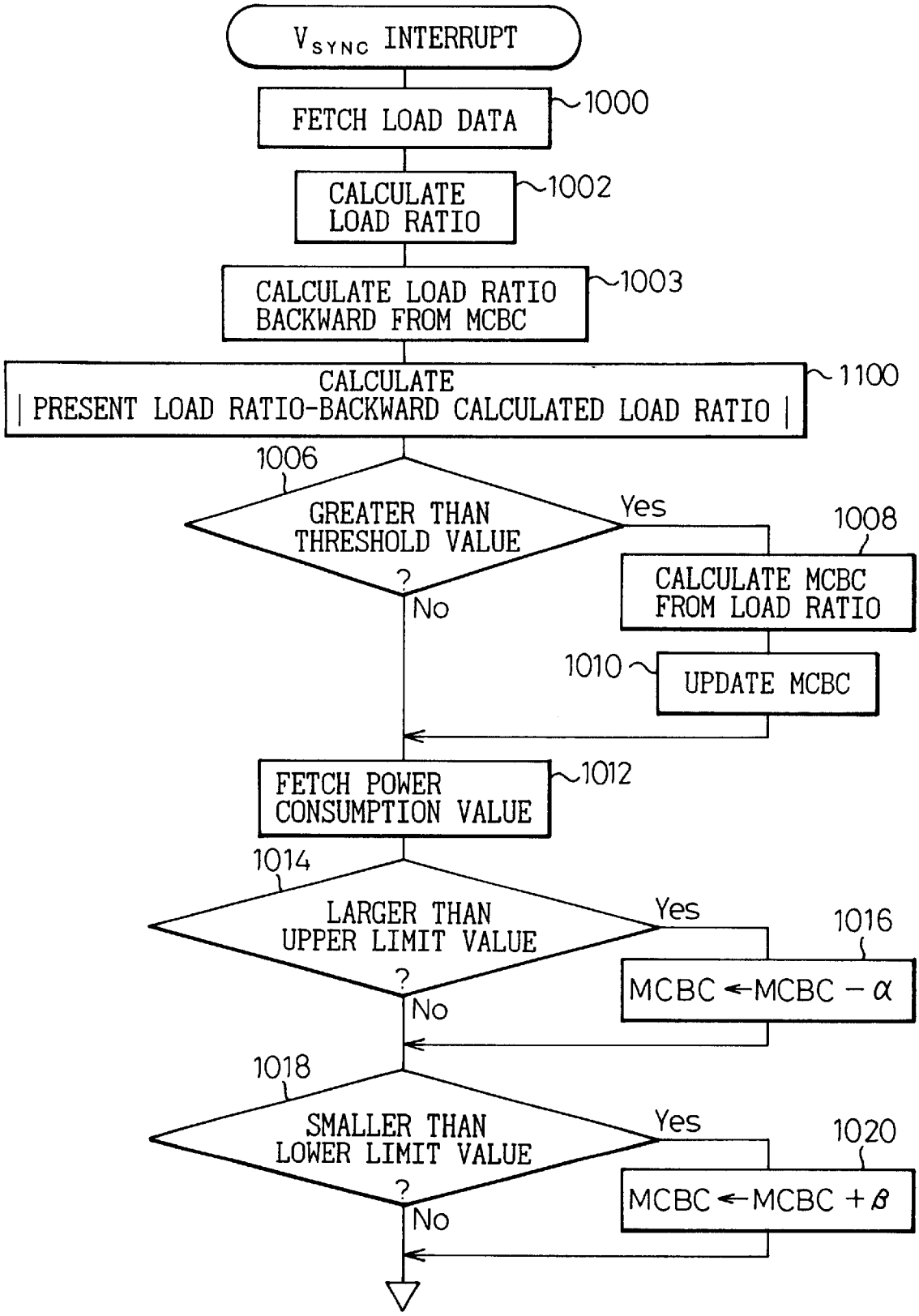
FIG. 8 is a flowchart illustrating power consumption control according to a third embodiment of the present invention.

FIG. 8 is a flowchart for power consumption control according to a third embodiment of the present invention. In this embodiment, after calculating the load ratio (step 1002), the load ratio is inversely calculated from the current MCBC value by reversing the calculation of equation (2) (step 1003). In step 1100, the difference is calculated between the present load ratio and the inversely calculated load ratio that provides the present MCBC value, and if the difference is greater than the threshold value, the MCBC value is updated to the value calculated from the load ratio (steps 1008 and 1010). The other steps are the same as those shown in FIG. 5.

Figure 7:
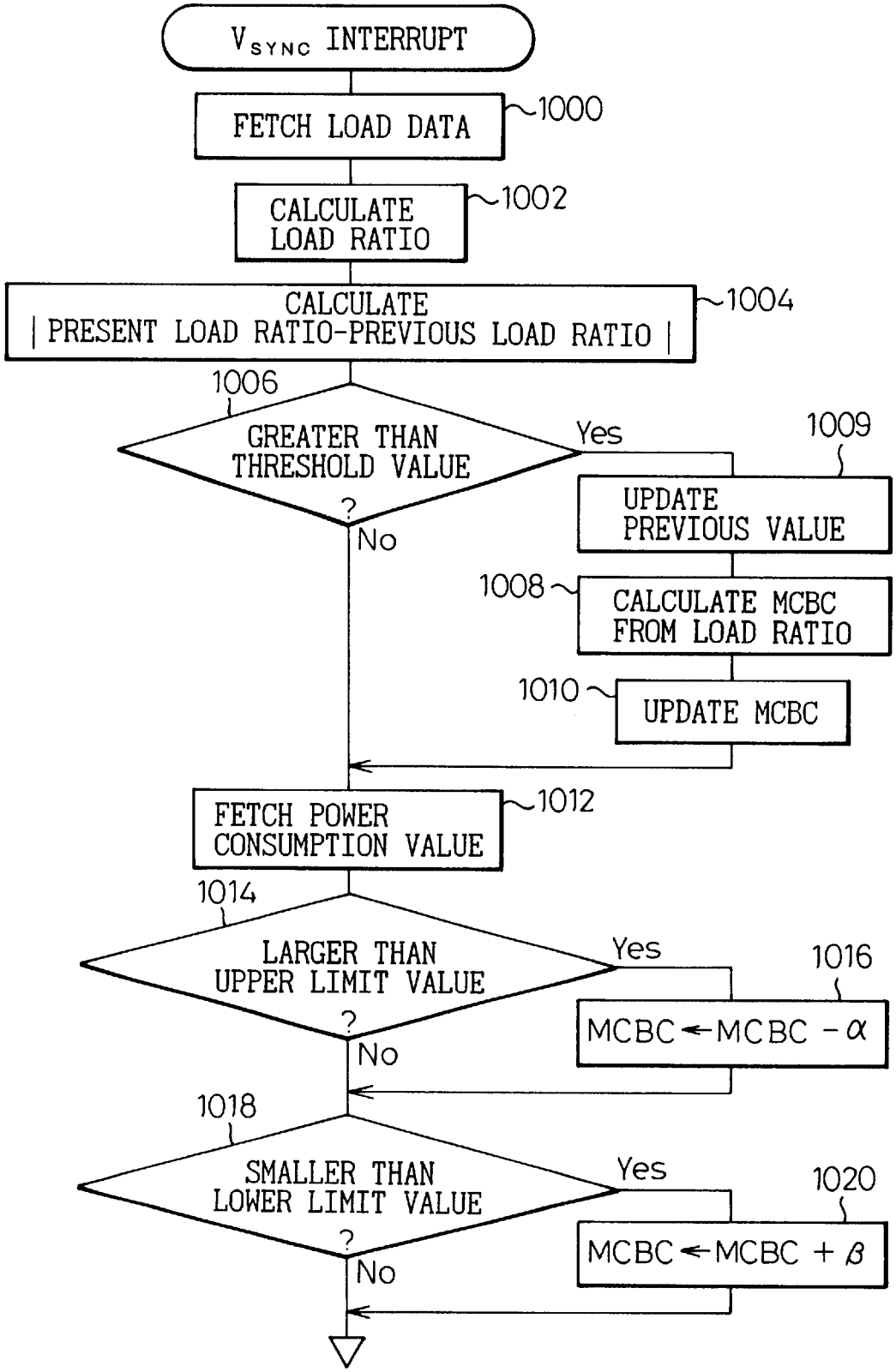
FIG. 7 is a flowchart showing a modification of FIG. 6.

As can be seen from a comparison between FIG. 8 and FIG. 7, in FIG. 8 the difference between the last updated load ratio and the load ratio obtained backward from the present MCBC value is compared with the threshold value to determine whether to update the MCBC to the value calculated from the load ratio, whereas in FIG. 7 the difference between the last updated load ratio and the present load ratio is compared with the threshold value.

Figure 9:
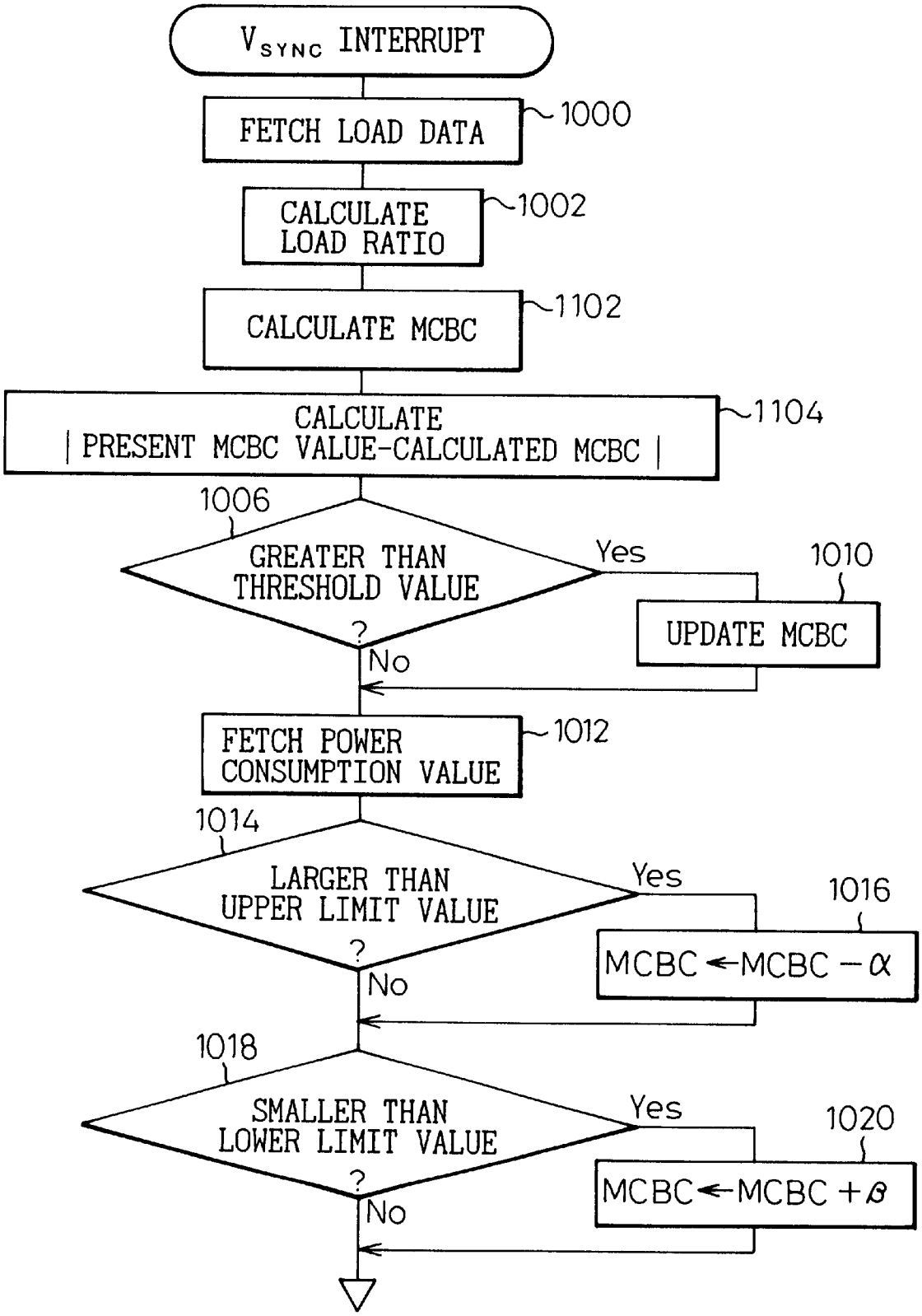
FIG. 9 is a flowchart illustrating power consumption control according to a fourth embodiment of the present invention.

FIG. 9 is a modification of the process of FIG. 8. In step 1102, the MCBC value is calculated from the present load ratio, and if the calculated MCBC value is displaced from the present MCBC value by more than the threshold value (steps 1104, 1106), the MCBC value is updated to the calculated value (step 1010).

In the present invention, when display data is received that causes an abrupt change in the load, the screen brightness is changed to a value appropriate to the load ratio before the data is actually displayed; this prevents transient variations in brightness inherent in feedback control. Furthermore, if the power consumption at the brightness determined from the load ratio is different from the target power consumption because of manufacturing variations, the power consumption can be made to settle down to the target value by performing control by measuring the power consumption.

In actual operation, if the power consumption at the brightness determined by the load ratio is lower than the preset power value, image brightness temporarily decreases and then increases; conversely, if it is higher than the preset power value, image brightness gradually decreases starting with bright portions. When the two cases are compared, the brightness change is less noticeable in the latter case where brightness decreases starting with bright portions. Accordingly, it is preferable to set the brightness so that the power consumption at the brightness determined by the load ratio is higher than the preset power value.

As described above, according to the present invention, power consumption control is provided that does not induce unnatural changes in brightness even when data causing an abrupt change in the ON/OFF state of the display is input, and that can control the power consumption at the desired value regardless of manufacturing variations.

What is claimed is:

1. A power consumption control method for a display unit, comprising the steps of:

(a) calculating a screen load ratio from display data to be applied to said display unit;

(b) measuring power consumption in said display unit; and (c) controlling screen brightness based on said calculated screen load ratio and stud measured power consumption in accordance with the substeps of:

(i) changing said screen brightness to a value appropriate to said calculated screen load ratio when said calculated screen load ratio exhibits a change exceeding a predetermined threshold value; and (ii) changing said screen brightness in steps in such a manner that said measured power consumption approaches a target value.

2. A method according to claim 1, wherein said substep (c) (i) includes the substeps of:

calculating backward from the present set value of screen brightness a load ratio that provides said set value; and changing said screen brightness to a value appropriate to the calculated screen load ratio when the difference between said backward calculated load ratio and said calculated screen load ratio exceeds a predetermined threshold.

3. A method according to claim 1, wherein said substep (c) (i) includes the substeps of:

storing said calculated screen load ratio; and changing said screen brightness to a value appropriate to the present load ratio and, at the same time, updating said stored load ratio, when the difference between said stored load ratio and said calculated screen load ratio exceeds a predetermined threshold.

4. A method according to claim 1, wherein said substep (c) (i) includes the substeps of:

calculating a brightness value appropriate to the calculated screen load ratio; and changing said screen brightness to a value appropriate to said calculated screen load ratio when the difference between said calculated brightness value and the screen brightness exceeds a predetermined threshold value.

5. A method according to claim 1, wherein the screen brightness appropriate to said calculated screen load ratio in said step (c) (i) is a value such that actual power consumption with said calculated screen load ratio is higher than target power consumption.

6. A method according to claim 1, wherein said display unit includes a plasma display panel and a plasma display panel control circuit for applying an appropriate number of sustain pulses to said plasma display panel within a prescribed period, said appropriate number being determined according to a brightness value supplied to said control circuit.

7. A power consumption control apparatus for a display unit, comprising:

means for calculating a screen load ratio from display data to be applied to said display unit;

means for measuring power consumption in said display unit; and means for controlling screen brightness based on said calculated screen load ratio and said measured power consumption, wherein said means for controlling screen brightness further comprises:

brightness changing means for changing said screen brightness to a value appropriate to said calculated screen load ratio when said calculation screen load ratio exhibits a change exceeding a predetermined threshold value and means for changing said screen brightness in steps in such a manner that said measured power consumption approaches a target value.

8. An apparatus according to claim 7, wherein said brightness changing means includes:

means for calculating backward from the present set value of screen brightness a load ratio that provides said set value; and means for changing said screen brightness to a value appropriate to the calculated screen load ratio when the difference between said backward calculated load ratio and said calculated screen load ratio exceeds a predetermined threshold.

9. An apparatus according to claim 7, wherein said brightness changing means includes:

means for storing said calculated screen load ratio; and means for changing said screen brightness to a value appropriate to the present load ratio and, at the same time, updating said stored load ratio and said calculated screen load ratio exceeds a predetermined threshold.

10. An apparatus according to claim 7, wherein said brightness changing means includes:

means for calculating a brightness value appropriate to the calculated screen load ratio; and means for changing said screen brightness to a value appropriate to said present load ratio when the difference between said calculated brightness value and the screen brightness exceeds a predetermined threshold value.

11. An apparatus according to claim 7, wherein the screen brightness appropriate to said calculated screen load ratio in said brightness changing means is a value such that actual power consumption with said calculated screen load ratio is higher than the target power consumption.

12. An apparatus according to claim 8, wherein said display unit includes a plasma display panel and a plasma display panel control circuit for applying an appropriate number of sustain pulses to said plasma display panel within a prescribed period, said appropriate number being determined according to a brightness value supplied to said control circuit.

13. A display system comprising:

a power consumption control apparatus comprising means for calculating a screen load ratio from display data to be applied to said display unit, means for measuring power consumption in said display unit and means for controlling screen brightness based on said calculated load screen ratio and said measured power consumption;

a plasma display panel;

a drive circuit driving said plasma display panel; and a controller controlling said drive circuit based on a brightness value supplied from said power consumption control apparatus, wherein said controller further comprises:

brightness changing means for changing said screen brightness to a value appropriate to said calculated screen load ratio when said calculated screen load ratio exhibits a change exceeding a predetermined threshold value, and means for changing said screen brightness in steps in such a manner that measured power consumption approaches a target value.

14. A display system according to claim 13, wherein said brightness changing means comprises:

means for calculating backward from the present set value of screen brightness a load ratio that provides said set value; and means for changing said screen brightness to a value appropriate to the calculated screen load ratio when the difference between said backward calculated load ratio and said calculated screen load ratio exceeds a predetermined threshold.

15. A display system according to claim 13, wherein said brightness changing means comprises:

means for storing said calculated screen load ratio; and means for changing said screen brightness to a value appropriate to the present load ratio and, at the same time, updating said stored load ratio, when the difference between said stored load ratio and said calculated screen load ratio exceeds a predetermined threshold.

16. A display system according to claim 13, wherein said brightness changing means comprises:

means for calculating a brightness value appropriate to the calculated screen load ratio; and means for changing said screen brightness to a value appropriate to said calculated screen load ratio when the difference between said calculated brightness value and the screen brightness exceeds a predetermined threshold value.

17. A display system according to claim 13, wherein the brightness value appropriate to said measured load ratio in said brightness changing means is a value such that actual power consumption with said measured load ratio is higher than target power consumption.

18. A program storage device readable by a machine tangibly embodying a program of instructions executable by the machine to perform method steps for controlling power consumption of a display unit, said method steps comprising:

(a) calculating a screen load ratio from display data to be applied to said display unit;

(b) measuring power consumption in said display unit;

(c) controlling screen brightness based on said calculated screen load ratio and said measured power consumption in accordance with:

(i) changing said screen brightness to a value appropriate to said calculated screen load ratio when said calculated screen load ratio exhibits a change exceeding a predetermined threshold value, and (ii) changing said screen brightness in steps in such a manner that said measured power consumption approaches a target value.

19. A program storage device according to claim 18, wherein said substep (c) (i) includes the substeps of:

calculating backward from the present set value of screen brightness a load ratio that provides said set value; and changing said screen brightness to a value appropriate to the calculated screen load ratio when the difference between said backward calculated load ratio and said calculated screen load ratio exceeds a predetermined threshold.

20. A program storage device according to claim 18, wherein said substep (c) (i) includes the substeps of:

storing said calculated screen load ratio; and changing said screen brightness to a value appropriate to the present load ratio and, at the same time, updating said stored load ratio, when the difference between said stored load ratio and said calculated screen load ratio exceeds a predetermined threshold.

21. A program storge device according to claim 18, wherein said substep (c) (i) includes the substeps of:

calculating a brightness value appropriate to the calculated screen load ratio; and changing said screen brightness to a value appropriate to said calculated screen load ratio when the difference between said calculated brightness value and the screen brightness exceeds a predetermined threshold value.

22. A program storage device according to claim 18, wherein the screen brightness value appropriate to said calculated screen load ratio in said step (c) (i) is a value such that actual power consumption with said calculated screen load ratio is higher than target power consumption.

23. A program storage device according to claim 2l, wherein said display unit includes a plasma display panel and a plasma display panel control circuit for applying an appropriate number of sustain pulses to said plasma display panel within a prescribed period, said appropriate number being determined according to a brightness value supplied to said control circuit.

* * * * *

UNITED STATES PATENT AND TRADEMARK OFFICE

CERTIFICATE OF CORRECTION

PATENT NO. : 6,326,938 B1
DATED : December 4, 2001
INVENTOR(S) : Katsuhiro Ishida et al.

It is certified that error appears in the above-identified patent and that said Letters Patent is hereby corrected as shown below:

Column 6,
Line 59, change "stud" to -- said --.

Signed and Sealed this

Ninth Day of April, 2002

*Attest:*

*Attesting Officer*

JAMES E. ROGAN
*Director of the United States Patent and Trademark Office*